United States Patent [19]

Van Gorkom

[11] Patent Number: 5,008,535

[45] Date of Patent: Apr. 16, 1991

[54] ENERGY ANALYZER AND SPECTROMETER FOR LOW-ENERGY ELECTRONS

[75] Inventor: Gerardus G. P. Van Gorkom, Eindhoven, Netherlands

[73] Assignee: U.S. Philips Corporation, New York, N.Y.

[21] Appl. No.: 400,182

[22] Filed: Aug. 29, 1989

[30] Foreign Application Priority Data

Sep. 2, 1988 [NL] Netherlands ..... 8802170

[51] Int. Cl.[5] ..... H01J 40/00

[52] U.S. Cl. ..... 250/305; 250/397

[58] Field of Search ..... 250/305, 309, 310, 397

[56] References Cited

U.S. PATENT DOCUMENTS

| | | | |
|---|---|---|---|
| 3,626,184 | 12/1971 | Crewe | 250/397 |
| 3,818,228 | 6/1974 | Palmberg | 250/305 |
| 4,126,781 | 11/1978 | Siegel | 250/305 |
| 4,584,474 | 4/1986 | Franchy et al. | 250/305 |
| 4,742,224 | 5/1988 | Chu et al. | 250/305 |
| 4,831,267 | 5/1989 | Brunner | 250/305 |
| 4,849,629 | 7/1989 | Daimon et al. | 250/309 |

*Primary Examiner*—Bruce C. Anderson

*Attorney, Agent, or Firm*—Paul R. Miller

[57] ABSTRACT

An energy analyzer for Auger electrons can be simply formed by means of a glass tube provided with a helical layer of ruthenium oxide. The loss in energy resolution which occurs upon detection outside the focal plane can be electronically compensated for by detecting the electrons by means of a segmented anode.

28 Claims, 3 Drawing Sheets

ENERGY ANALYZER AND SPECTROMETER FOR LOW-ENERGY ELECTRONS

Figure 1:
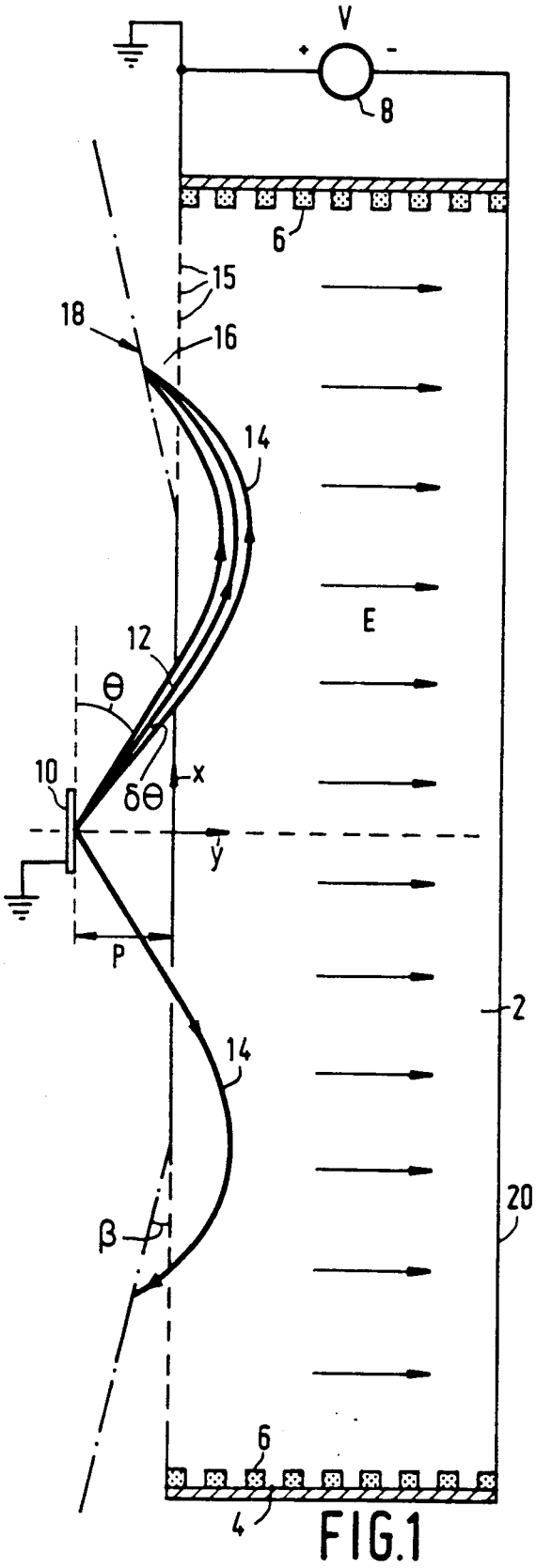

The invention relates to an energy analyser for low-energy electrons, comprising an analyser space in which a homogeneous and uniform electric field can be generated and which comprises an entrance aperture and an exit aperture and a detector for detecting electrons emanating from the exit aperture.

The invention also relates to a spectrometer for low-energy electrons.

An energy analyser of this kind is known from: "The Rev. of Sc. In."; 1970, Vol. 41, No. 10; pp. 1409–1414.

The known energy analyser comprises a space in which a uniform field prevails. The uniform field is generated by a number of parallel, plate-shaped electrodes provided with a slit-shaped aperture across which a locally linearly varying potential prevails. Electrons which enter the analyser via an entrance aperture are exposed to a decelerating force in a direction which will be referred to hereinafter as the y-direction. Within the analyser the electrons follow a parabolic path, the path outside the analyser being rectilinear. The distance travelled by the electrons in a direction perpendicular to the y-direction, referred to hereinafter as the x direction, is proportional to their kinetic energy. The spatial dispersion caused by the energy analyser, therefore, is a measure of the energy spectrum. For electrons of equal energy the path travelled in the x direction is a function $f(\theta)$ of the angle $\theta$ enclosed by a speed vector and the x-direction upon entry. The focussing effect of an energy analyser is better as the path travelled in the x direction is less dependent on the angle of entry. It can be demonstrated that second order focussing (where the first and the second derivative in the Taylor expansion of $f(\theta)$ around $\theta$ are equal to 0) occurs if the angle of entry is 30°.

The known energy analyser has the drawback that its dimensions are comparatively large (length approximately 35 cm and height 7 cm) which makes it necessary to use a vacuum system adapted to these dimensions. Moreover, the construction of the energy analyser is complex and hence comparatively expensive. Furthermore, the known analyser is not rotationally symmetrical and hence not very well suitable for so-called Auger measurements. Auger electrons are low-energy electrons released from one of the outer electron shells by photoabsorption of a photon released either upon electron interception or upon energy transition of an electron, i.e. via an "internal" photoelectric effect. Auger measurements are used inter alia for surface analyses. By bombardment of a specimen with electrons an electron can be released from one of the inner shells. In the case of electron absorption or transition so that the vacant position in the shell is filled, energy is released which is capable of releasing an Auger electron having an arbitrary propagation direction. For the analysis of Auger electrons emitted by a specimen, therefore, a rotationally symmetrical energy analyser is required.

It is an object of the invention to provide a rotationally symmetrical energy analyser which is capable of measuring a comparatively large number of energies in parallel and which has small dimensions, a simple construction and a low cost price.

To achieve this, an energy analyser of the kind set forth in accordance with the invention is characterized in that the analyser space is enclosed by a rotationally symmetrical electrically insulating tubular section, an inner side of which is provided with a helical electrical resistance layer which is coaxial with the tubular section which is bounded at two ends by an electric conductor.

By using a tubular analyser section in accordance with the invention, a very uniform and homogeneous electric field is obtained whereby the energy spectrum of, for example Auger electrons can be measured. It is comparatively simple to manufacture the analyser and, depending on the length of the analyser in the x direction, for example 100 different energies can be simultaneously measured. By adapting the voltage across the helical resistance layer a range of the analyser can be adjusted for successive energy intervals. For an entry angle of the electrons of 30° with respect to the x-direction, a width of the entrance slit amounting to 2.4 mm, and a distance between a specimen to be examined and the entrance slit which amounts to 7 mm, an energy resolution of 3.8 $10^{-4}$ can be achieved. The energy analyser is compact and has a general diameter of 8 cm in the x-direction and a width of approximately 5 mm in the the y-direction.

It is to be noted that a rotationally symmetrical electrically insulating tubular section comprising a helical electrical resistance layer provided on its inner side so as to be coaxial with the tubular section is known per se from Netherlands Patent Application NL 8600391.

The cited Patent Application discloses a method of manufacturing a glass tubular section with a helical resistance layer of ruthenium oxide and also describes its use in a cathode ray tube. The use of the glass tubular section as an energy analyser, however, is not mentioned and is not evident from the Patent Application either.

An embodiment of an energy analyser in accordance with the invention is characterized in that the exit aperture is formed by an annular slit which is coaxial with the tubular section and which is provided with a fine-meshed gauze, a detection entrance face of the detector being situated in a focal plane which coincides with a part of an envelope of cone of a straight circular cone having an apex situated on the symmetry axis so that second order focussing takes place in the focal plane for electrons of equal energy. In the focal plane the energy resolution is constant and maximum. The angle $\beta$ enclosed by the focal plane and the x direction is a function of the entry angle $\theta$ of the electrons and amounts to substantially 11° for $\theta=30°$. Because the exit aperture is provided with a fine-meshed gauze the electric field in the vicinity of the aperture is substantially equal to the field in the analyser space, so that no field lines emerge through the aperture.

A further embodiment of an energy analyser in accordance with the invention is characterized in that the detection means comprise a channel plate. Because the number of electrons is small during detection of, for example Auger electrons, low noise amplification is necessary. A matrix-like configuration of tubular electron multipliers, a so-called channel plate, is suitable in this respect. An electron entering a tubular channel releases a number of electrons from a secondary emissive material covering the wall of the channel, which number is exponentially multiplied in the channel. At the exit of each channel the electron flow can be measured.

A further embodiment of an energy analyser in accordance with the invention is characterized in that the detector comprises a second fine-meshed gauze which is situated in the detection entrance plane and whose potential equals the potential at the area of the exit aperture, the energy analyser comprising intensifier means which cooperate with the detector and which include a flat, annular channel plate which is coaxial with the tubular section and carries a potential which is higher than that of the second fine-meshed gauze, the analyser also comprising an anode which cooperates with the intensifier means. The manufacture of a channel plate in the form of a part of an envelope of cone is complicated. In order to avoid such complications, a fine-meshed gauze can also be used as a detector. Electrons emanating from the exit aperture follow straight paths in the field-free space between the aperture and the second gauze. Subsequently, they are accelerated towards the channel plate so that any position on the second gauze corresponds substantially to a position on the channel plate. The electron flow from the channel plate is detected by means of an annular anode arranged behind the channel plate. The anode is formed, for example by a number of concentric conductive rings on an electrically insulating ceramic substrate. Each ring measures the number of electrons in a given energy interval. The signals originating from the anode rings are processed simultaneously, for example by a computer.

A further preferred embodiment in accordance with the invention is characterized in that the exit aperture is formed by an annular slit which is coaxial with the tubular section, the detector comprising an annular, flat channel plate which is arranged opposite the exit aperture and which is concentric with the exit aperture, the energy analyser comprising an anode. The anode preferably comprises a number of conductive anode rings which are electrically insulated from one another and which can be electrically conductively connected to one another in a two-by-two fashion. In order to simplify the construction of the energy analyser, the detector is situated outside the focal plane. As a result, the resolution of the detector depends on the position in the x direction. Because a varying width of the anode rings is impractical, all rings have the same width, a minimum width thereof being determined by the desired resolution. For a higher efficiency of the energy analyser with a lower resolution, a number of neighbouring anode rings can be electrically interconnected.

Another embodiment in accordance with the invention is characterized in that the anode rings are formed by segments which are electrically insulated from one another. Because the exciting electron beam scans a finite part of the specimen, the source is not point-shaped with respect to the analyser, so that the energy resolution decreases. Electrons originating from parts of the specimen which are not situated on the x axis have an energy spectrum which has been shifted in the x direction. By providing the anode rings with insulating tracks in a number of radial directions (one of which is formed by the x direction), a number of wedge-shaped anode surfaces subdivided into mutually insulated anode segments are obtained. The signals originating from anode segments situated on a wedge-shaped anode surface define a sub-spectrum which is a fraction of the total energy spectrum. For different anode surfaces the sub-spectra have been shifted with respect to one another. In order to determine the total energy spectrum which is formed by the sum of the sub-spectra, the sub-spectra should be shifted in known manner with respect to a reference spectrum in relation with an instantaneous position of the exciting electron beam. The energy spectrum which best approximates the spectrum of a point-shaped specimen can thus be determined.

Instead of using an anode comprising segmented anode rings, use can also be made of an anode which is formed by a matrix of mutually electrically insulated anode elements. An energy spectrum which has been corrected for deviations due to the finite dimensions of the specimen is obtained by summing signals from groups of anode elements of corresponding energy. By selectively summing signals from groups of anode elements, resolution and sensitivity can be adjusted within a wide range.

Another embodiment in accordance with the invention is characterized in that the energy analyser comprises demagnifying an auxiliary electron lens which cooperates with the entrance aperture. By using a demagnifying auxiliary lens which reduces, for example by a factor 5, a scan amplitude which is five times higher can be used for the same resolution. The loss of efficiency introduced by the use of the auxiliary lens can be compensated for by the simultaneous measurement of a large number of energies. An additional advantage of the use of an auxiliary lens consists in that secondary and reflected electrons do not reach the analyser due to chromatic aberrations. The signal-to-noise ratio of the signal from the anode rings is thus enhanced.

A further preferred embodiment in accordance with the invention is characterized in that inside a first tubular section there is arranged a second, electrically insulating tubular section which is coaxial with the tubular section, on the outer side of said second tubular section there being provided a helical electrical resistance layer which is coaxial with the tubular section while on the inner side there is provided an electrically conductive layer so that the space within the second tubular section is substantially field-free. An electron gun producing an exciting electron beam, possibly converged by an auxiliary electron lens, is coaxially arranged with respect to the tubular section, thus facilitating the scanning of the specimen so that the spot size of the electron beam on the specimen is as small as possible. The exciting electron beam is incident on the specimen through the field-free space around the y axis of the analyser. The energy-dependent dispersion takes place in a uniform, homogeneous electric field in the space of the analyser section which surrounds the field-free space. If the inner side of the second glass tubular section is provided with a helical resistance layer instead of an electrically the conductive layer, the exciting electron beam can be converged under influence of the converging effect of the second tubular section instead of by means of an auxiliary electron lens.

Figure 2:
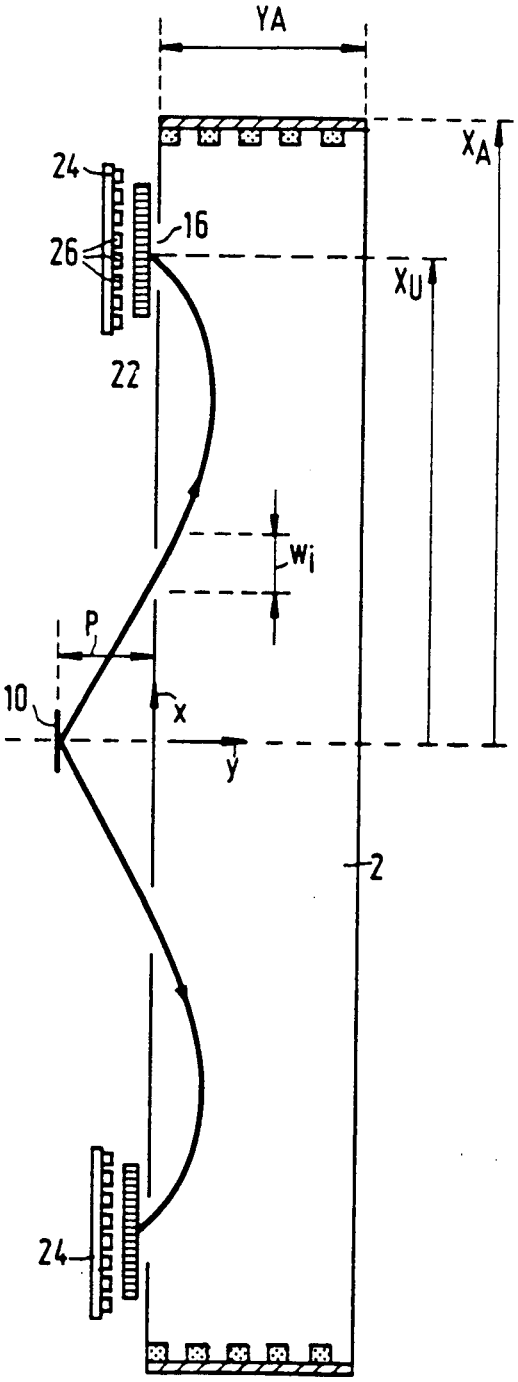
Figure 3A:
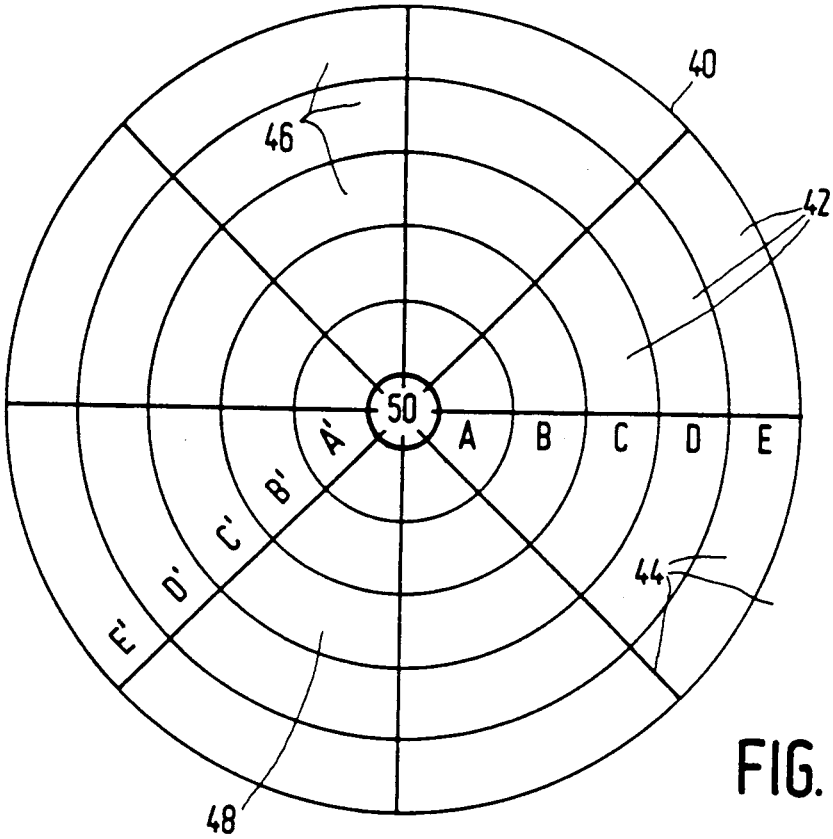
Figure 3B:
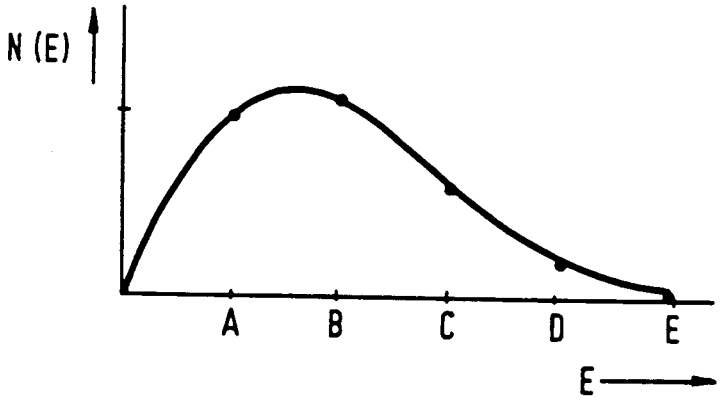
Figure 3C:
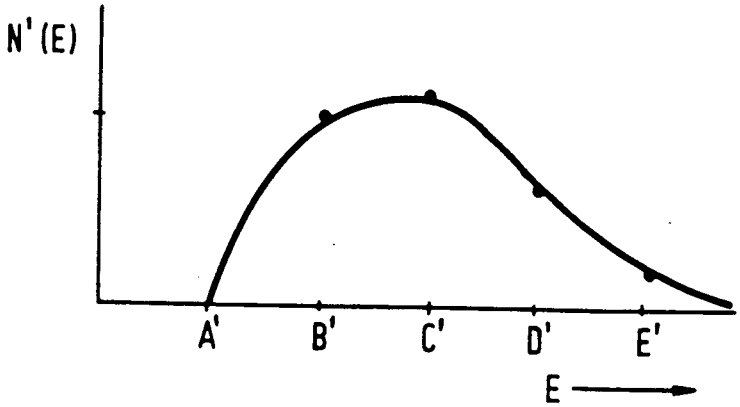
Figure 4:
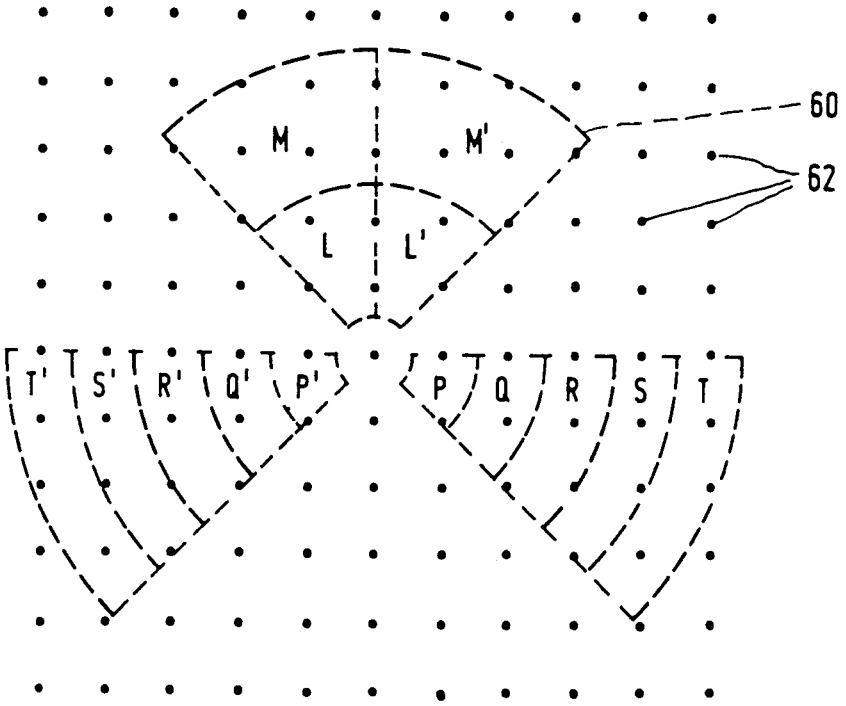
Figure 5:
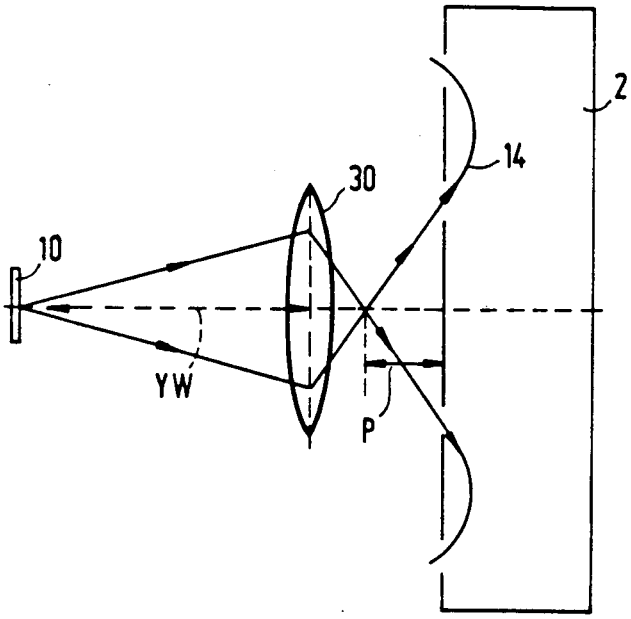
Figure 6:
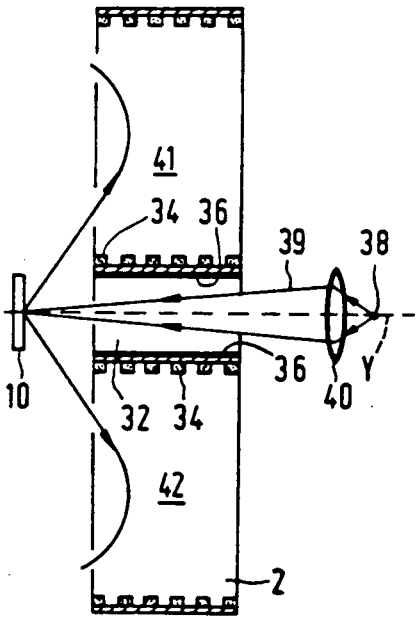

Some embodiments in accordance with the invention will be described in detail hereinafter with reference to the accompanying drawing; therein FIG. 1 diagrammatically shows a device comprising an energy analyser, FIG. 2 diagrammatically shows a device comprising an energy analyser with detectors arranged outside a focal plane, FIG. *3a* shows an annular anode with anode segements, FIGS. 3*b* and 3*c* diagrammatically show two energy spectra which have been shifted with respect to one another, FIG. 4 shows an anode comprising a matrix of anode elements, FIG. 5 diagrammatically shows the position of an auxiliary electron lens, and FIG. 6 diagrammatically shows a preferred embodiment of an energy analyser in accordance with the invention.

FIG. 1 shows an energy analyser, comprising an analyser section 2 which is formed by a glass tubular section 4. On the inner side of the tubular section 4 there is provided a helical resistance layer 6 which acts as a voltage divider for a voltage generated by a voltage source 8. Thus, in the tubular section 4 there is generated a uniform and homogeneous electric field E in which electrons are decelerated. Electrons emerging from a specimen 10 (the specimen is irradiated by an electron gun which is not shown in the Figure and which is arranged outside the analyser section 2) enter the analyser section at an entry angle $\theta$ of 30° through an entrance aperture 12. The spread in the entry angle $\theta$ amounts to, for example 0.05 rad. After having travelled a parabolic path 14 through the analyser section, electrons of equal energy emerge from the analyser section 2 through an exit aperture 16 covered by a fine-meshed gauze 15 and reach a field-free space after which they converge in a focal plane 18. The focal plane 18 coincides with a part of an envelope of cone and encloses an angle $\beta$ of substantially 11° with respect to the x-direction. The first focal point is situated on the x-axis at a height amounting to 3V3 P, where P is the distance between the specimen 10 and the analyser section 2. The tubular section 4 is closed at two ends by an electric conductor 20 and is rotationally symmetrical with respect to the y axis.

FIG. 2 shows an analyser section 2 in which the detection means and the intensifier means are not situated in the focal plane 18. At a level $x_u$ in which $x_u$ coincides with a first point of the focal plane 18 and which amounts to 3.6 cm for a specimen distance of 7 mm there is provided an exit aperture 16 which has a width of 2.9 mm. Electrons emerging from the exit aperture 16 are incident on a flat, annular channel plate 22 in which the electron current is intensified. The intensified electron current is detected by an anode 24 which is formed by a number of mutually electrically insulated conductive anode rings 26. A constant width of the anode rings is determined by the lowest permissible energy resolution. For variation of the angle of entry of 0.05 rad and a specimen distance of 7 mm 17 anode rings can be used for obtaining a resolution of 0.2%. By utilizing 51 anode rings having a ring width of 56 $\mu$m (the width of an anode ring plus insulation between two anode rings), 3 different resolutions can be obtained. For an energy resolution of 0.2%, every third anode ring is used; for a resolution of 0.4%, 34 anode rings are used, which anode rings are pair-wise electrically interconnected, and for a resolution of 0.6% all anode rings are used for the detection, each time 3 rings being electrically interconnected.

FIG. 3*a* shows an annular anode 40, comprising a number of conductive anode rings 42 which are electrically insulated from one another. The anode 40 is subdivided into wedge-shaped anode surfaces 48 by insulating tracks 44 which extend in the radial direction, said wedge-shaped surfaces being divided into anode segments 46. In the centre of the anode there is situated an aperture 50 wherethrough electrons emanating from the specimen 10 can enter the energy analyser 2. In the case of a point-shaped specimen, electrons of the same energy are incident (in intensified form) on the same anode ring. Because of the finite dimensions of the specimen, for a surface section subdivided into anode segments A–E an energy sub-spectrum N(E), as shown in FIG. 3*b*, is measured, while for a surface section subdivided into anode segments A′–E′ there is measured an energy sub-spectrum N(E′) as shown in FIG. 3*c*. By summing the signals of the anode segments A and B′, B and C′, C and D′, D and E′ (energy sub-spectrum N(E′) is shifted and added to the energy sub-spectrum N(E)), and by adding it to other anode segments of corresponding energy, a total energy spectrum will be obtained which best approximates the energy spectrum of a point-shaped specimen.

FIG. 4 shows an anode 60 which is formed by a matrix of mutually electrically insulated anode elements 62. Energy sub-spectra N(E) and N(E′) as shown in FIGS. 3*b* and 3*c* are obtained by summing the signals from anode elements situated on surfaces P, Q, R, S and T, and P′, Q′, R′, S′, and T′, respectively. The spectrum N(E′) is shifted and N(E) and N(E′) are summed by summing the signals from the anode elements on P and those on Q′, on Q and R′, etc. A spectrum having a higher sensitivity and a lower resolution can be measured by summing the signals from anode elements situated on surfaces L and M and the signals from anode elements associated with the corresponding energy (for example summing of L and M′).

FIG. 5 diagrammatically shows an energy analyser comprising an auxiliary electron lens 30 which is arranged between the specimen 10 and the analyser section 2. A specimen size of 100 $\mu$m results in a relative energy resolution of 0.5%; a size of 200 $\mu$m results in a resolution of 1%, etc. By using the demagnifying auxiliary electron lens 30, an energy spectrum of adequate resolution can still be measured for a specimen of finite dimensions. The free working distance $Y_w$ between the specimen and the lens is larger than the free working distance in the absence of the auxiliary lens 30. As a result, the surface of the specimen can be treated, for example cleaned, without it being necessary to displace the specimen.

FIG. 6 shows an energy analyser in which a second glass tubular section 32 is situated in the analyser section 2. On the outside of the tubular section 32 there is provided a helical resistance layer of ruthenium oxide 34. On the inner side of the tubular section 32 there is provided a conductive layer 36 so that the space inside the tubular section 32 is field-free. On the y axis there is arranged an electron gun 38 which makes an electron beam 39, converged by an electron lens 40, incident on the specimen 10. The electrons emitted by the specimen 10 are separated according to energy in the analyser sections 41 and 42.

I claim:

1. An energy analyzer for low-energy electrons comprising (a) an electrically insulating tubular section having rotational symmetry disposed about an analyzer space, a homogeneous and uniform electrical field being generated in said analyzer space, said analyzer space including an entrance aperture and an exit aperture, said exit aperture being an annular slot, (b) a helical electrical resistance layer disposed at an inner side of said tubular section, said helical electrical resistance layer being coaxial with said tubular section, (c) an electrical conductor disposed at ends of said tubular section, and (d) detector means for detecting electrons emanating from said exit aperture, said detector means including an annular, flat channel plate arranged opposite to said exit aperture, said annular, flat channel plate being concentric with said exit aperture, wherein said energy analyzer comprises an anode, said anode including a number of anode rings electrically insulated from one another, said number of anode rings being electrically interconnected in a two-by-two fashion.

2. A energy analyzer according to claim 1, wherein said anode rings include segments being electrically insulated from one another.

3. An energy analyzer according to claim 1, wherein said tubular section is glass, and wherein said helical electrical resistance layer is ruthenium oxide.

4. An energy analyzer according to claim 1, wherein demagnifying auxiliary electron lens means are included for cooperating with said entrance aperture.

5. An energy analyzer according to claim 4, wherein said auxiliary electron lens means includes a rotationally symmetrical glass tubular section having an inner side of a helical electrical resistance layer coaxial with said glass tubular section, said helical electrical resistance layer being ruthenium oxide.

6. An energy analyzer according to claim 1, wherein said tubular section is provided with a coaxial second electrically insulating tubular section having a second helical electrical resistance layer disposed on an outer side, said second tubular section having an electrically conductive layer on an inner side, such that a space within said second tubular section is substantially field-free.

7. An energy analyzer according to claim 1, wherein a second electrically insulating tubular section is disposed coaxially within said tubular section, said second tubular section having a coaxial helical electrical resistance layer on both an inner side and an outer side, said electrical resistance layer being ruthenium oxide, and wherein said second tubular section has a focussing effect on electrons.

8. An energy analyzer for low-energy electrons comprising (a) an electrically insulating tubular section having rotational symmetry disposed about an analyzer space, a homogeneous and uniform electrical field being generated in said analyzer space, said analyzer space including an entrance aperture and an exit aperture, said exit aperture being an annular slot, (b) a helical electrical resistance layer disposed at an inner side of said tubular section, said helical electrical resistance layer being coaxial with said tubular section, (c) an electrical conductor disposed at ends of said tubular section, and (d) detector means for detecting electrons emanating from said exit aperture, said detector means including an annular, flat channel plate arranged opposite to said exit aperture, said annular, flat channel plate being concentric with said exit aperture, wherein said energy analyzer comprises an anode, said anode including a matrix of mutually electrically insulated anode elements.

9. An energy analyzer according to claim 8, wherein said tubular section is glass, and wherein said helical electrical resistance layer is ruthenium oxide.

10. An energy analyzer according to claim 8, wherein demagnifying auxiliary electron lens means are included for cooperating with said entrance aperture.

11. An energy analyzer according to claim 10, wherein said auxiliary electron lens means includes a rotationally symmetrical glass tubular section having an inner side of a helical electrical resistance layer coaxial with said glass tubular section, said helical electrical resistance layer being ruthenium oxide.

12. An energy analyzer according to claim 8, wherein said tubular section is provided with a coaxial second electrically insulating tubular section having a second helical electrical resistance layer disposed on an outer side, said second tubular section having an electrically conductive layer on an inner side, such that a space within said second tubular section is substantially field-free.

13. An energy analyzer according to claim 8, wherein a second electrically insulating tubular section is disposed coaxially within said tubular section, said second tubular section having a coaxial helical electrical resistance layer on both an inner side and an outer side, said electrical resistance layer being ruthenium oxide, and wherein said second tubular section has a focussing effect on electrons.

14. An energy analyzer for low-energy electrons comprising (a) an electrically insulating tubular section having rotational symmetry about a symmetry axis, said tubular section being disposed about an analyzer space, a homogeneous and uniform electrical field being generated in said analyzer space, said analyzer space including an entrance aperture and an exit aperture, said exit aperture being an annular slit coaxial with said tubular section, said annular slit being provided with a first fine-meshed gauze (b) a helical electrical resistance layer disposed at an inner side of said tubular section, said helical electrical resistance layer being coaxial with said tubular section, (c) an electrical conductor disposed at ends of said tubular section, (d) detector means for detecting electrons emanating from said exit aperture, said detector means having a detection entrance face situated in a focal plane coinciding with a part of an envelope of a straight circular cone having an apex on said symmetry axis, such that second order focussing occurs in said focal plane for equal energy electrons, (e) a second fine-meshed gauze disposed in said detection entrance face, said second fine-meshed gauze having a potential equaling a potential at an area of said exit aperture, and (f) intensifier means cooperating with said detector means for carrying a potential higher than that of said second fine-meshed gauze, said intensifier means including a flat, annular channel plate coaxial with said tubular section, wherein said energy analyzer comprises an anode cooperating with said intensifier means, said anode being an electrically insulating substrate including a number of metal rings coaxial with said tubular section, said number of metal rings being electrically insulated from one another.

15. An energy analyzer according to claim 14, wherein said metal rings include segments electrically insulated from one another.

16. A spectrometer for low-energy electrons comprising an energy analyzer according to claim 14, wherein means are provided for simultaneously detecting signals originating from said anode and for determining an energy spectrum by summing signals having the same energy.

17. An energy analyzer according to claim 14, wherein said tubular section is glass, and wherein said helical electrical resistance layer is ruthenium oxide.

18. An energy analyzer according to claim 14, wherein demagnifying auxiliary electron lens means are included for cooperating with said entrance aperture.

19. An energy analyzer according to claim 18, wherein said auxiliary electron lens means includes a rotationally symmetrical glass tubular section having an inner side of a helical electrical resistance layer coaxial with said glass tubular section, said helical electrical resistance layer being ruthenium oxide.

20. An energy analyzer according to claim 14, wherein said tubular section is provided with a coaxial second electrically insulating tubular section having a second helical electrical resistance layer disposed on an outer side, said second tubular section having an electrically conductive layer on an inner side, such that a space within said second tubular section is substantially field-free.

21. An energy analyzer according to claim 14, wherein a second electrically insulating tubular section is disposed coaxially within said tubular section, said second tubular section having a coaxial helical electrical resistance layer on both an inner side and an outer side, said electrical resistance layer being ruthenium oxide, and wherein said second tubular section has a focussing effect on electrons.

22. An energy analyzer for low-energy electrons comprising (a) an electrically insulating tubular section having rotational symmetry about a symmetry axis, said tubular section being disposed about an analyzer space, a homogeneous and uniform electrical field being generated in said analyzer space, said analyzer space including an entrance aperture and an exit aperture, said exit aperture being an annular slit coaxial with said tubular section, said annular slit being provided with a first fine-meshed gauze (b) a helical electrical resistance layer disposed at an inner side of said tubular section, said helical electrical resistance layer being coaxial with said tubular section, (c) an electrical conductor disposed at ends of said tubular section, (d) detector means for detecting electrons emanating from said exit aperture, said detector means having a detection entrance face situated in a focal plane coinciding with a part of an envelope of a straight circular cone having an apex on said symmetry axis, such that second order focussing occurs in said focal plane for equal energy electrons, (e) a second fine-meshed gauze disposed in said detection entrance face, said second fine-meshed gauze having a potential equaling a potential at an area of said exit aperture, and (f) intensifier means cooperating with said detector means for carrying a potential higher than that of said second fine-meshed gauze, said intensifier means including a flat, annular channel plate coaxial with said tubular section, wherein said energy analyzer comprises an anode cooperating with said intensifier means, said anode including a matrix of mutually electrically insulated anode elements.

23. A spectrometer for low-energy electrons comprising an energy analyzer according to claim 22, wherein means are provided for simultaneously detecting signals originating from said anode and for determining an energy spectrum by summing signals having the same energy.

24. An energy analyzer according to claim 22, wherein said tubular section is glass, and wherein said helical electrical resistance layer is ruthenium oxide.

25. An energy analyzer according to claim 22, wherein demagnifying auxiliary electron lens means are included for cooperating with said entrance aperture.

26. An energy analyzer according to claim 25, wherein said auxiliary electron lens means includes a rotationally symmetrical glass tubular section having an inner side of a helical electrical resistance layer coaxial with said glass tubular section, said helical electrical resistance layer being ruthenium oxide.

27. An energy analyzer according to claim 22, wherein said tubular section is provided with a coaxial second electrically insulating tubular section having a second helical electrical resistance layer disposed on an outer side, said second tubular section having an electrically conductive layer on an inner side, such that a space within said second tubular section is substantially field-free.

28. An energy analyzer according to claim 22, wherein a second electrically insulating tubular section is disposed coaxially within said tubular section, said second tubular section having a coaxial helical electrical resistance layer on both an inner side and an outer side, said electrical resistance layer being ruthenium oxide, and wherein said second tubular section has a focussing effect on electrons.

* * * * *